US010471489B2

(12) United States Patent
Klinect

(10) Patent No.: US 10,471,489 B2
(45) Date of Patent: Nov. 12, 2019

(54) ROLL FORMER

(71) Applicant: FAMOUS INDUSTRIES, INC., Mount Vernon, OH (US)

(72) Inventor: Charles Klinect, Cambridge, OH (US)

(73) Assignee: FAMOUS INDUSTRIES, INC., Mount Vernon, OH (US)

( * ) Notice: Subject to any disclaimer, the term of this patent is extended or adjusted under 35 U.S.C. 154(b) by 525 days.

(21) Appl. No.: 14/776,895

(22) PCT Filed: Mar. 17, 2014

(86) PCT No.: PCT/US2014/030411
§ 371 (c)(1),
(2) Date: Sep. 15, 2015

(87) PCT Pub. No.: WO2014/145616
PCT Pub. Date: Sep. 18, 2014

(65) Prior Publication Data

US 2016/0038986 A1 Feb. 11, 2016

Related U.S. Application Data

(60) Provisional application No. 61/792,512, filed on Mar. 15, 2013.

(51) Int. Cl.

| | |
|---|---|
| ***B21D 5/12*** | (2006.01) |
| ***B21C 37/10*** | (2006.01) |
| ***B21D 39/02*** | (2006.01) |

(52) U.S. Cl.
CPC ..... *B21D 5/12* (2013.01); *B21C 37/101* (2013.01); *B21D 39/02* (2013.01)

(58) Field of Classification Search
CPC . B21D 5/06; B21D 5/08; B21D 5/086; B21D 5/12; B21D 5/14; B21D 39/02; B21D 39/026; B21D 5/004; B21C 37/0818; B21C 37/0822; B21C 37/101; F16L 25/0081
See application file for complete search history.

(56) References Cited

U.S. PATENT DOCUMENTS

| | | | | |
|---|---|---|---|---|
| 2,650,112 A | | 8/1953 | Kinkead | |
| 3,648,007 A | * | 3/1972 | Oppermann | B23K 15/006 219/121.13 |
| 4,058,996 A | | 11/1977 | Schaeffer et al. | |

(Continued)

FOREIGN PATENT DOCUMENTS

FR 2617067 A1 * 12/1988 ..... B21C 37/107

OTHER PUBLICATIONS

Translation, FR 2617067A1, Dec. 1988.*

*Primary Examiner* — Edward T Tolan
(74) *Attorney, Agent, or Firm* — Reed Smith LLP

(57) ABSTRACT

A roll forming apparatus including a plurality of stations each including and an upper roll and a lower roller, wherein a first number of stations are configured to form a pipe blank into a standing seam, and a second number of stations are configured to angle the seam. At least one station includes elongated top and bottom rollers for clinching the pipe blank during the roll forming process. Each elongated top roller is mounted on a pivotable shaft configured to pivot the elongated top rollers away the pipe blank to allow passage of at least one seam formed in the pipe blank.

8 Claims, 37 Drawing Sheets

(56) References Cited

U.S. PATENT DOCUMENTS

| | | | | |
|---|---|---|---|---|
| 7,448,246 | B2 * | 11/2008 | Briese | B21D 5/08 72/177 |
| 7,478,467 | B2 * | 1/2009 | Gudenburr | F16L 25/0081 138/162 |
| 7,677,071 | B2 | 3/2010 | Heirich | |
| 7,992,904 | B2 | 8/2011 | Bloom et al. | |
| 8,499,604 | B2 * | 8/2013 | Borwig | B21D 5/04 29/521 |
| 2004/0244454 | A1 * | 12/2004 | McDonald | B21D 5/08 72/181 |
| 2008/0017269 | A1 | 1/2008 | Gudenburr et al. | |
| 2010/0077821 | A1 | 4/2010 | Borwig et al. | |

* cited by examiner

FIG. 15B
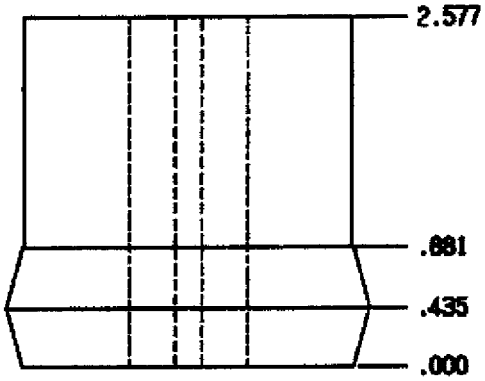
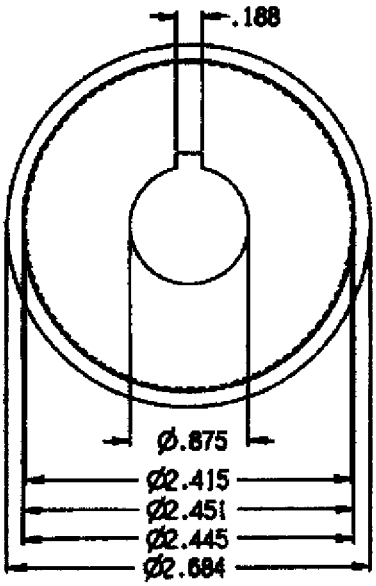
FIG. 15A
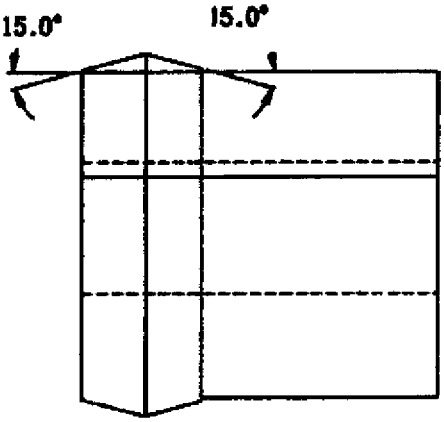
FIG. 15C

FIG. 16B
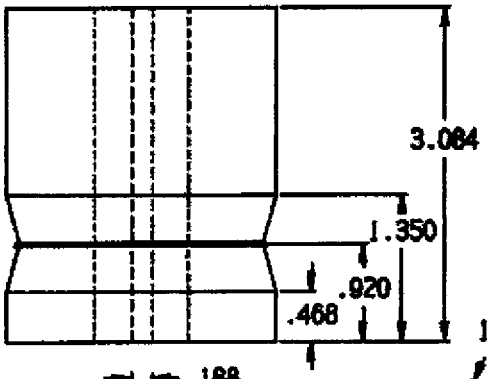
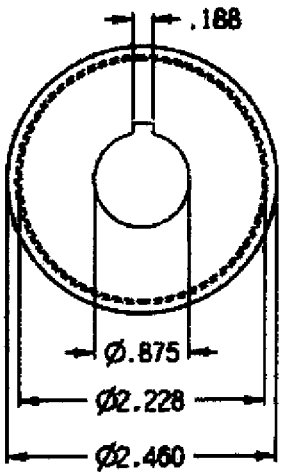
FIG. 16A
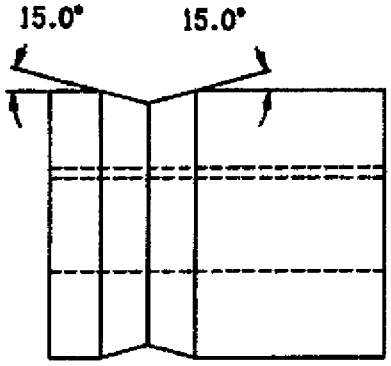
FIG. 16C

FIG. 17B
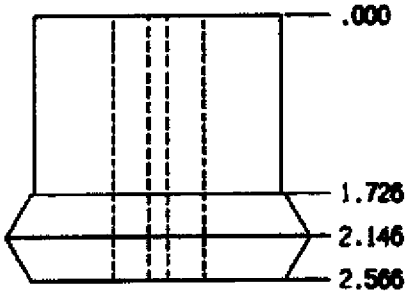
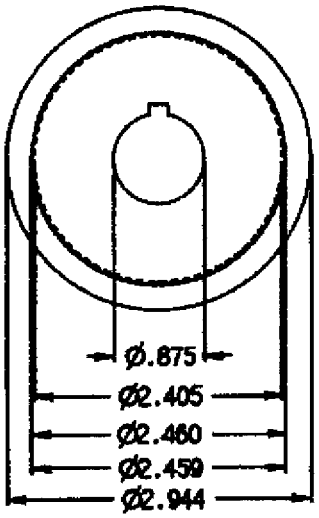
FIG. 17A
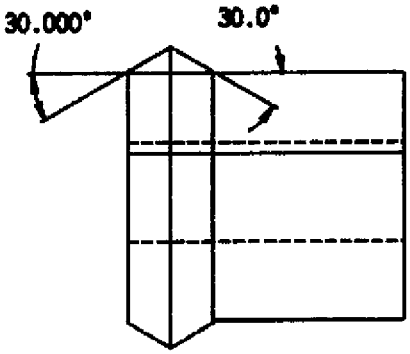
FIG. 17C

FIG. 18B
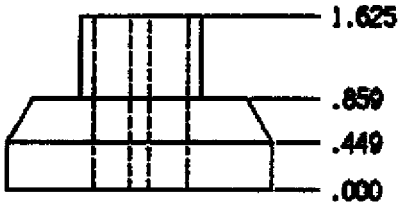
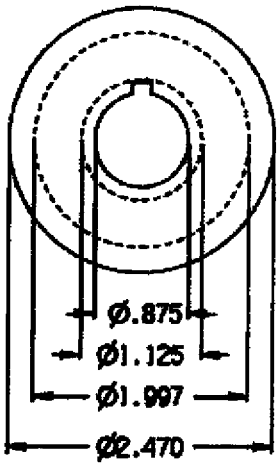
FIG. 18A
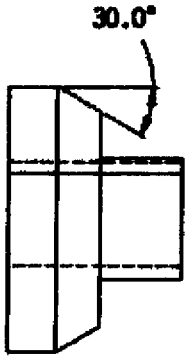
FIG. 18C

FIG. 19B
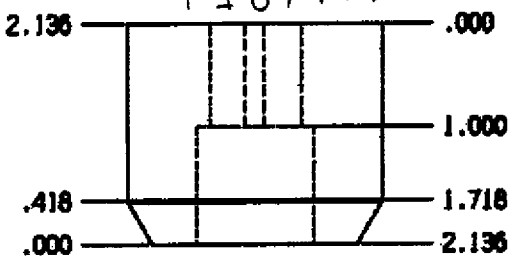
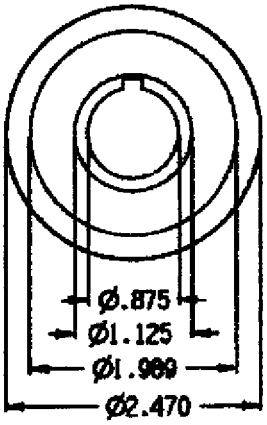
FIG. 19A
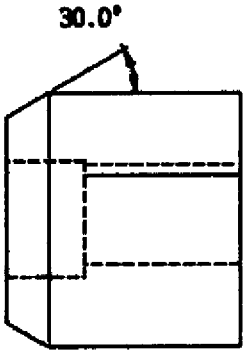
FIG. 19C

FIG. 20B
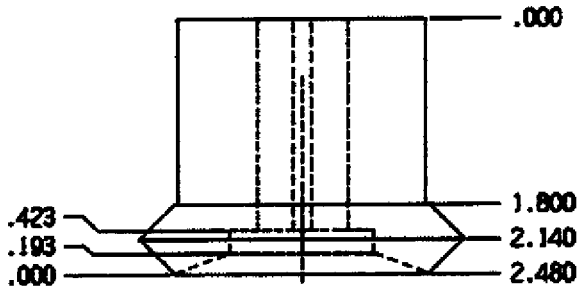
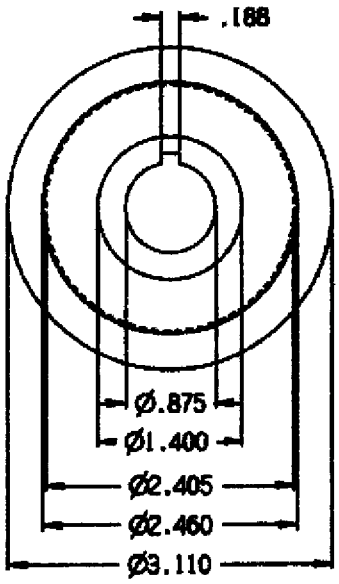
FIG 20A
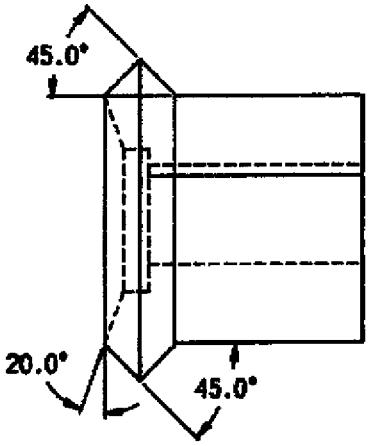
FIG. 20C

FIG. 21B
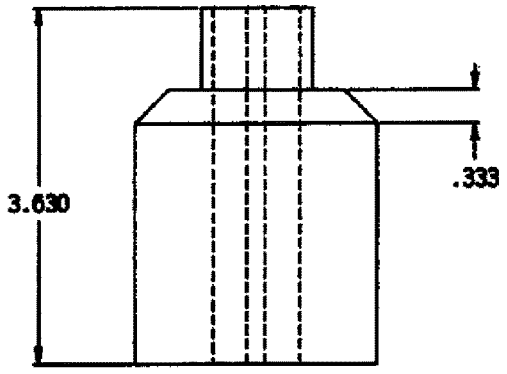
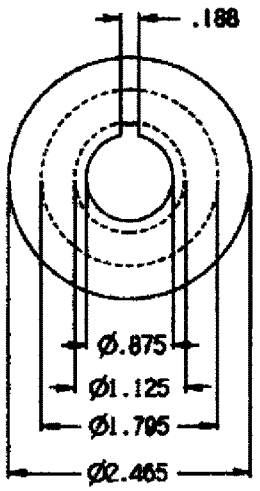
FIG. 21A
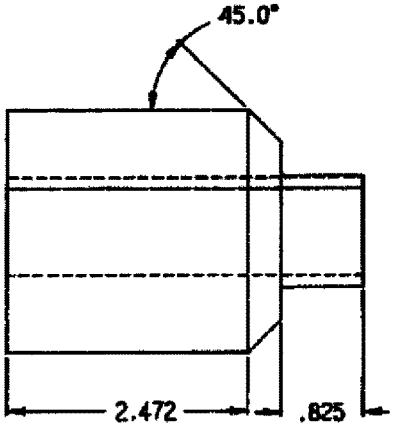
FIG. 21C

FIG. 22B
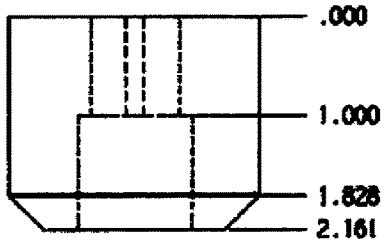
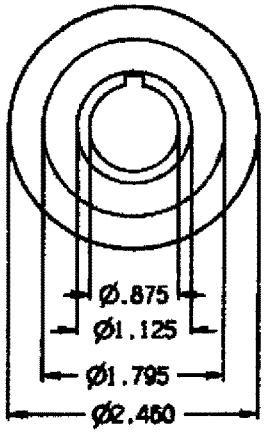
FIG. 22A
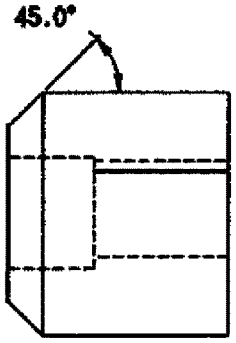
FIG. 22C

FIG. 23B
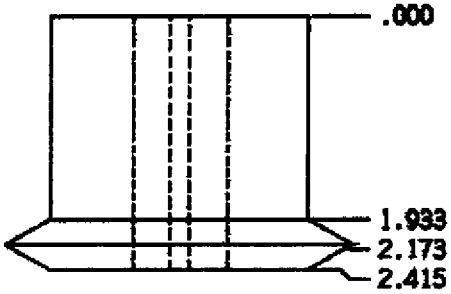
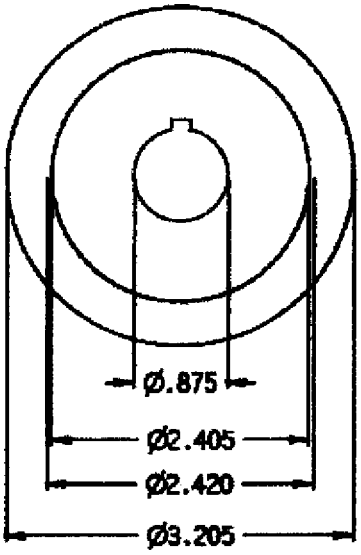
FIG. 23A
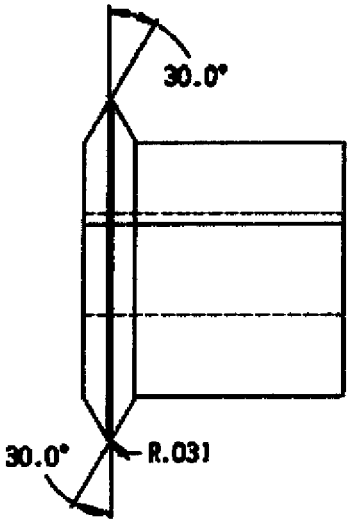
FIG. 23C

FIG. 24B
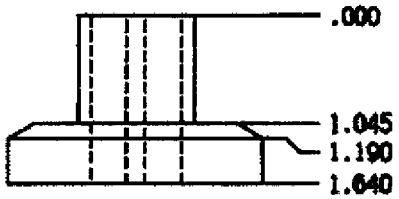
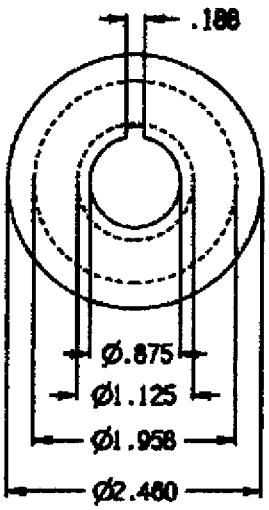
FIG. 24A
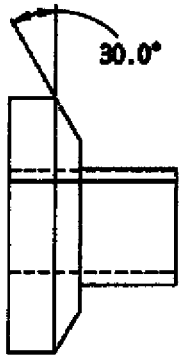
FIG. 24C

FIG. 25B
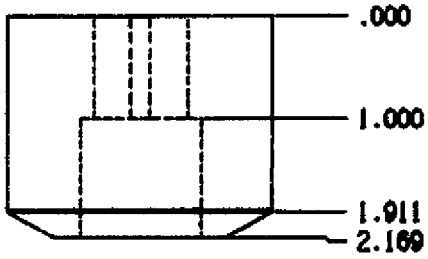
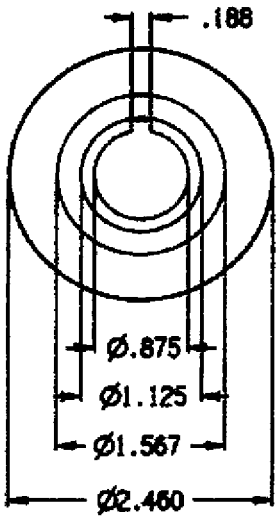
FIG. 25A
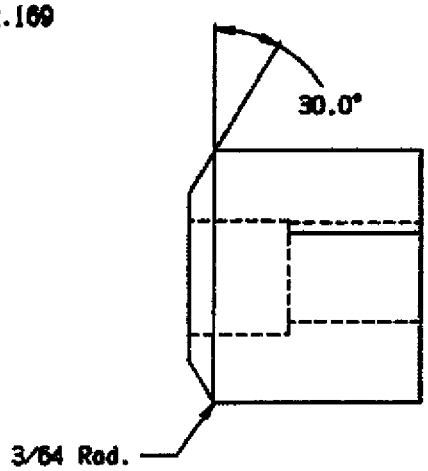
FIG. 25C

FIG. 26B
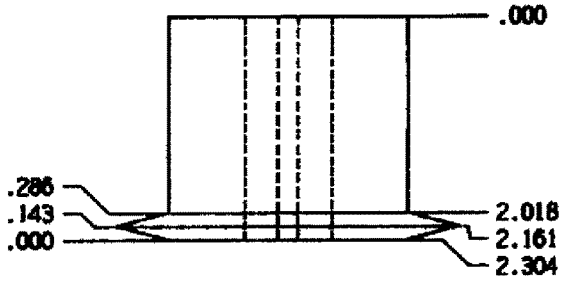
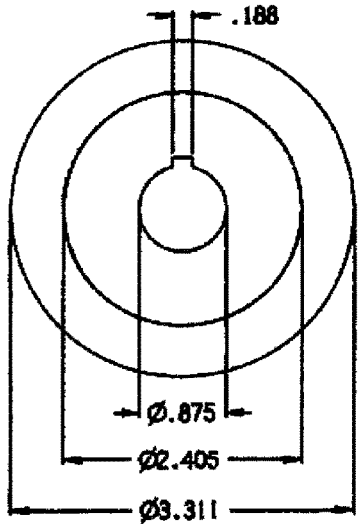
FIG. 26A
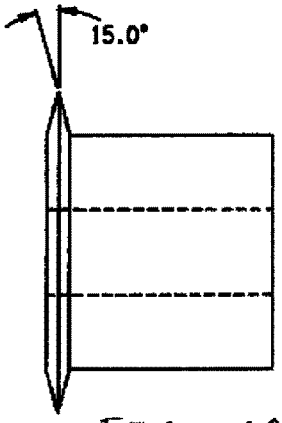
FIG. 26C

FIG. 27B
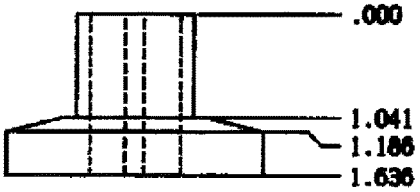
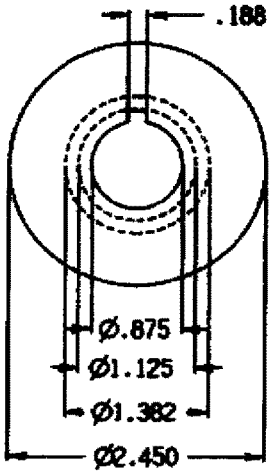
FIG. 27A
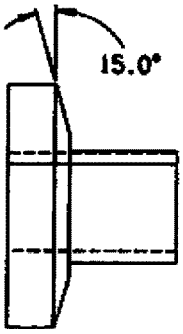
FIG. 27C

FIG. 28B
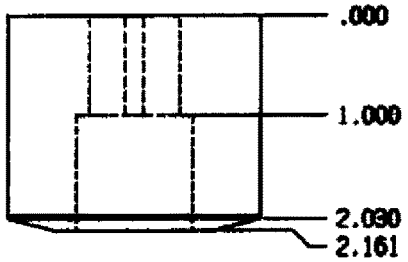
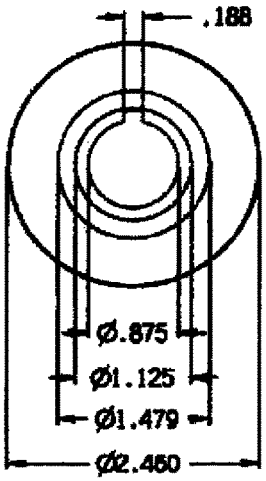
FIG. 28A
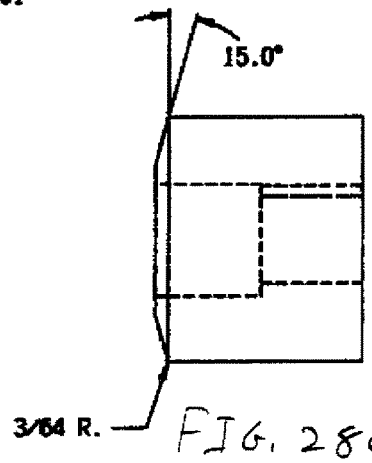
FIG. 28C

FIG. 29B
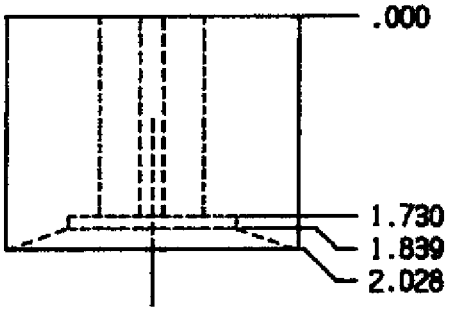
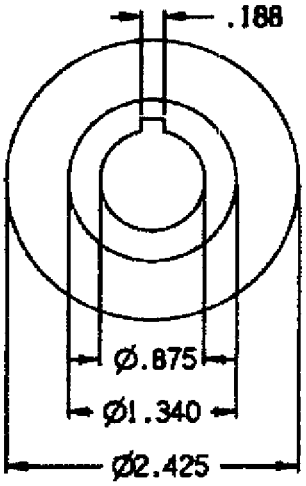
FIG. 29A
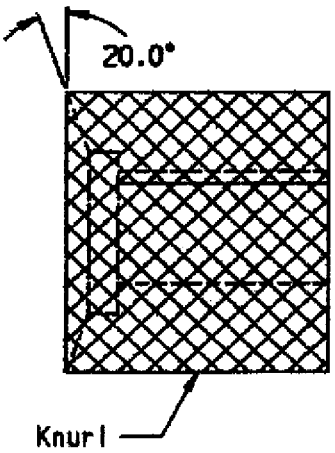
FIG. 29C

FIG. 30B
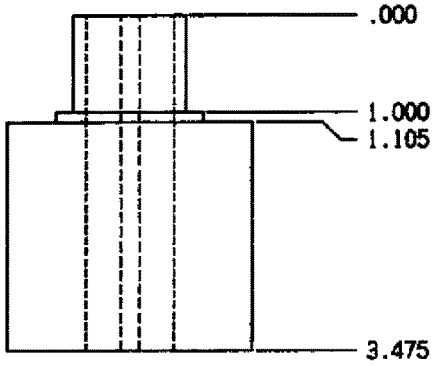
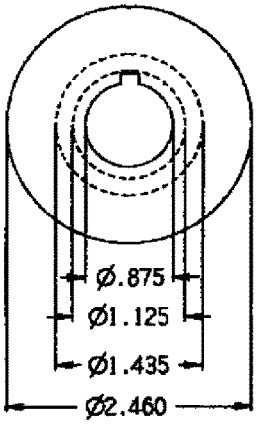
FIG. 30A
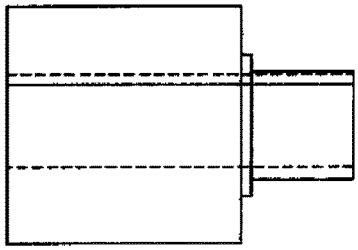
FIG. 30C

FIG. 31B
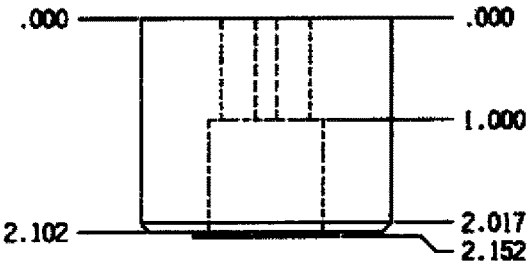
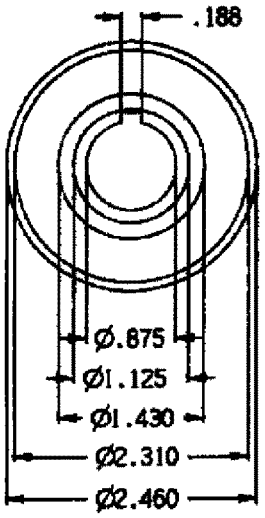
FIG. 31A
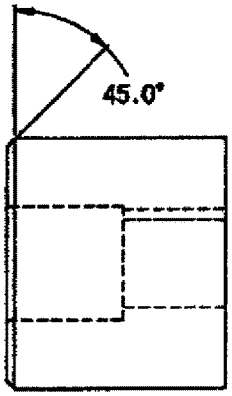
FIG. 31C

FIG. 32B
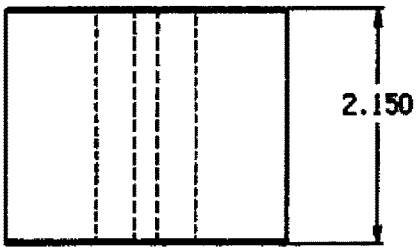
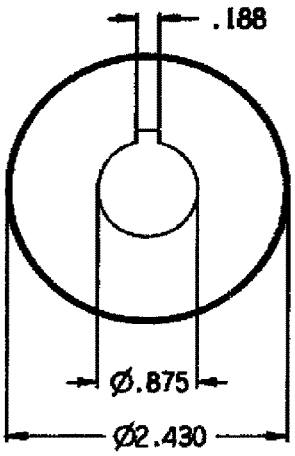
FIG. 32A
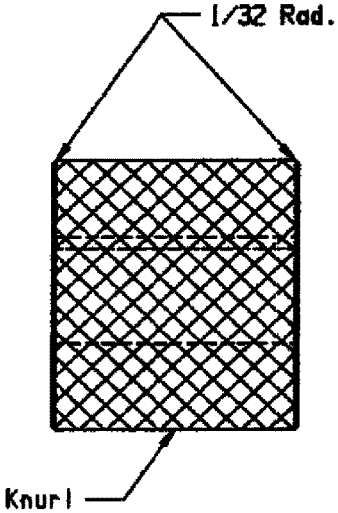
FIG. 32C

FIG. 33B
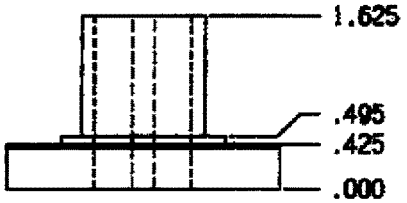
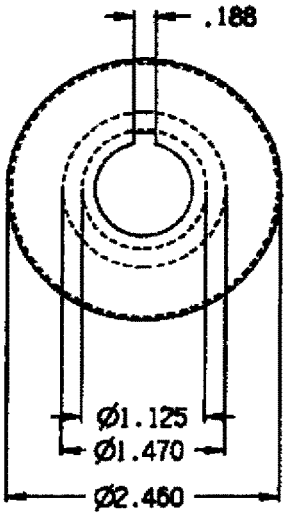
FIG. 33A
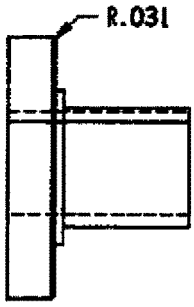
FIG. 33C

FIG. 34B
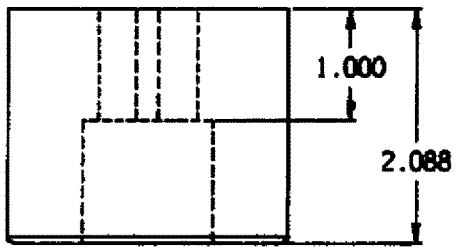
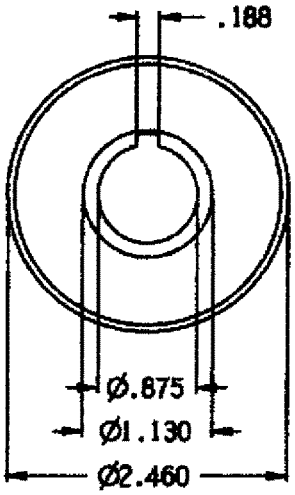
FIG. 34A
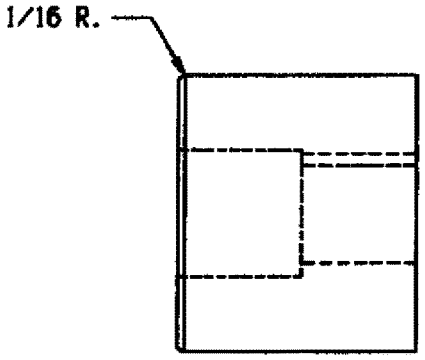
FIG. 34C

FIG. 35B
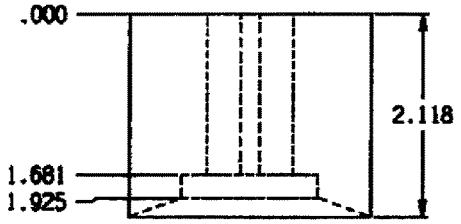
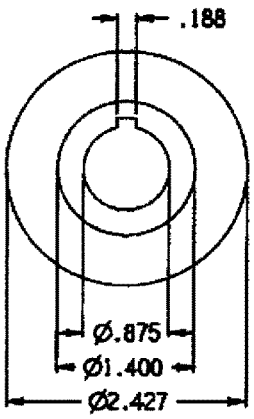
FIG. 35A
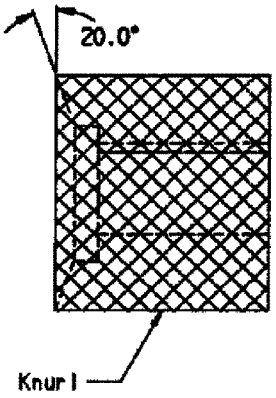
FIG. 35C

FIG. 36B
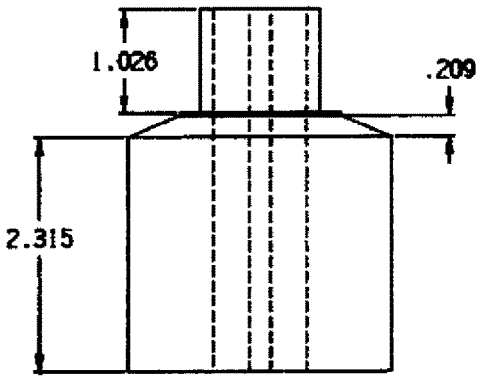
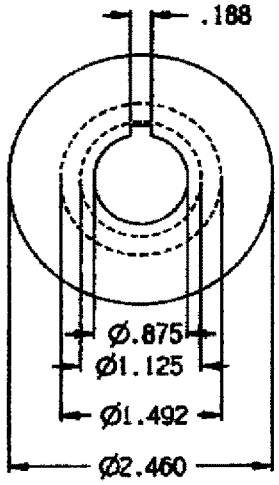
FIG. 36A
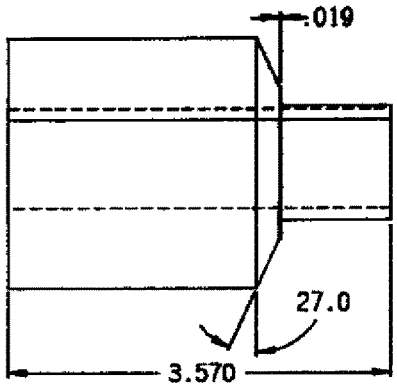
FIG. 36C

FIG. 37B
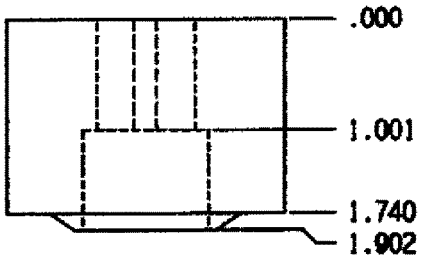
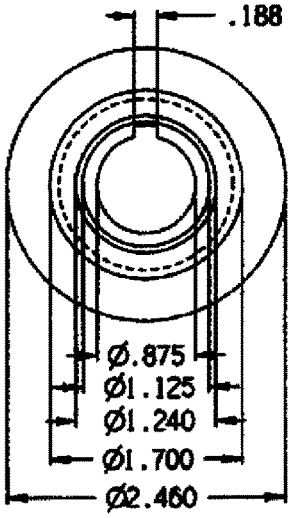
FIG. 37A
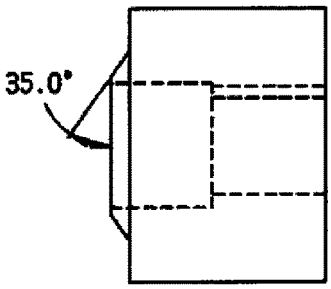
FIG. 37C

FIG. 38B
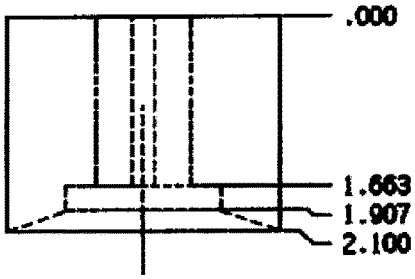
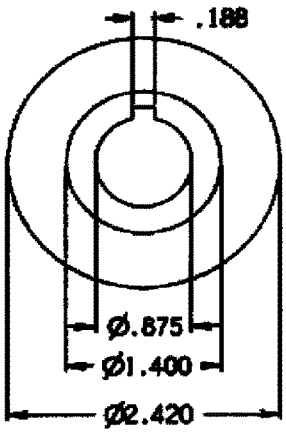
FIG. 38A
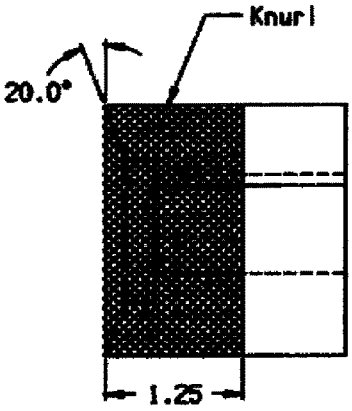
FIG. 38C

FIG. 39B
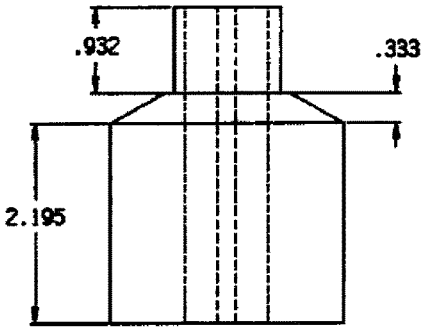
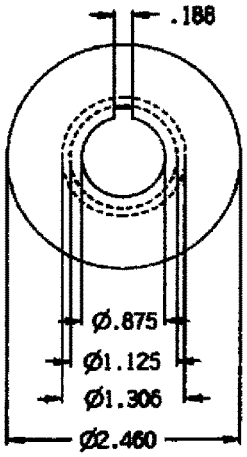
FIG. 39A
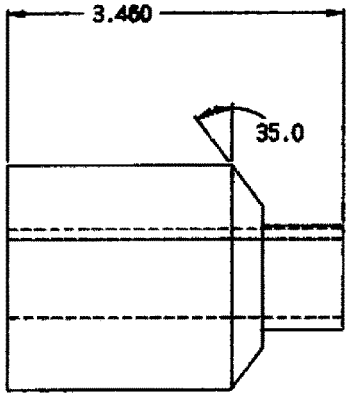
FIG. 39C

FIG. 40B
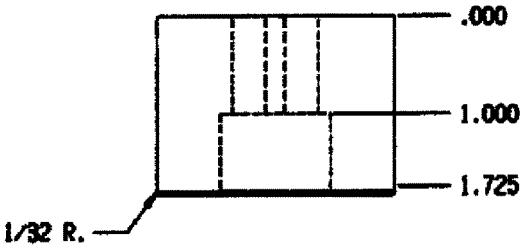
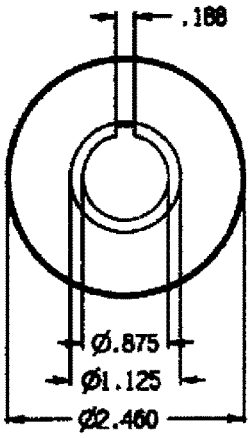
FIG. 40A
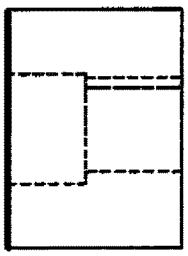
FIG. 40C

FIG. 41B
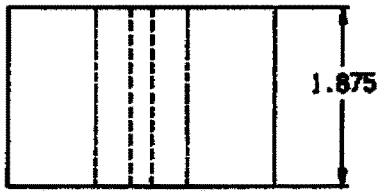
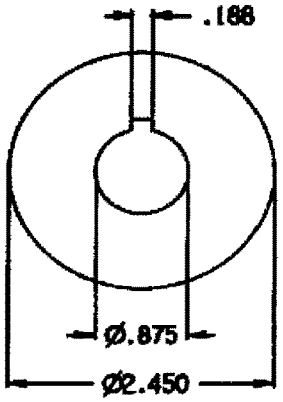
FIG. 41A
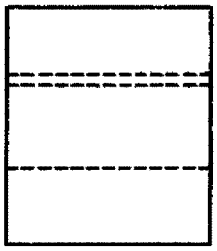
FIG. 41C

FIG. 42B
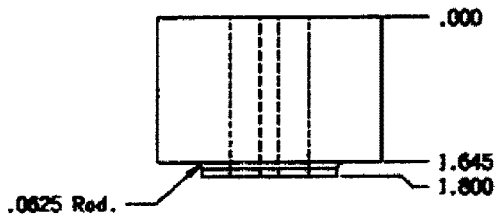
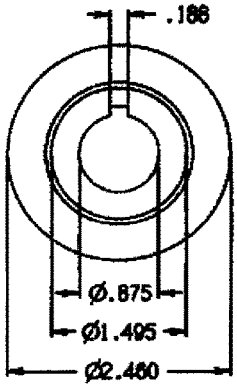
FIG. 42A
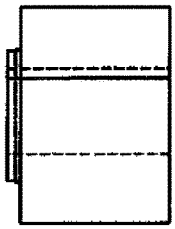
FIG. 42C

ROLL FORMER

CROSS-REFERENCE TO RELATED APPLICATION

This application is a United States national stage of International Application No. PCT/US2014/030411, filed Mar. 17, 2014, which published as International Publication No. WO 2014/145616, and which claims the benefit under 35 U.S.C. § 119(e) of the earlier filing date of U.S. Provisional Patent Application No. 61/792,512 filed on Mar. 15, 2013, which is hereby incorporated by reference.

FIELD OF INVENTION

This application is generally directed to the field of roll formers.

BACKGROUND

Products used in heating/ventilation/air conditioning (HVAC) units are typically formed of sheet stock such as sheet metal. Examples of metals include steel, aluminum and the like. In particular, pipe or duct work for HVAC units is typically made from one or more sections of sheet stock that are formed to create a conduit. In general, duct work or conduit may have a round and/or rectangular cross section. The sections of steel conduit are joined to create the duct work. Seams are created along each pipe section where the sheet stock is joined resulting in steel against steel joint. Roll formers are typically used to form sheet metal into ducts.

BRIEF DESCRIPTION OF THE DRAWINGS

Various embodiments of the invention are described herein by way of example in conjunction with the following figures, wherein like reference characters designate the same or similar elements.

FIGS. 15A-15C show end and two side views of the top roll of station 1 of FIG. 10.

FIGS. 16A-16C show end and two side views of the bottom roll of station 1 of FIG. 10.

FIGS. 17A-17C show end and two side views of the top roll of station 2 of FIG. 10.

FIGS. 18A-18C show end and two side views of the bottom front roll of station 2 of FIG. 10.

FIGS. 19A-19C show end and two side views of the bottom rear roll of station 2 of FIG. 10.

FIGS. 20A-20C show end and two side views of the top roll of station 3 of FIG. 10.

FIGS. 21A-21C show end and two side views of the bottom front roll of station 3 of FIG. 10.

FIGS. 22A-22C show end and two side views of the bottom rear roll of station 3 of FIG. 10.

FIGS. 23A-23C show end and two side views of the top roll of station 4 of FIG. 10.

FIGS. 24A-24C show end and two side views of the bottom front roll of station 4 of FIG. 10.

FIGS. 25A-25C show end and two side views of the bottom rear roll of station 4 of FIG. 10.

FIGS. 26A-26C show end and two side views of the top roll of station 5 of FIG. 10.

FIGS. 27A-27C show end and two side views of the bottom front roll of station 5 of FIG. 10.

FIGS. 28A-28C show end and two side views of the bottom rear roll of station 5 of FIG. 10.

FIGS. 29A-29C show end and two side views of the top roll of station 6 of FIG. 10.

FIGS. 30A-30C show end and two side views of the bottom front roll of station 6 of FIG. 10.

FIGS. 31A-31C show end and two side views of the bottom rear roll of station 6 of FIG. 10.

FIGS. 32A-32C show end and two side views of the top roll of station 7 of FIG. 10.

FIGS. 33A-33C show end and two side views of the bottom front roll of station 7 of FIG. 10.

FIGS. 34A-34C show end and two side views of the bottom rear roll of station 7 of FIG. 10.

FIGS. 35A-35C show end and two side views of the top roll of station 8 of FIG. 10.

FIGS. 36A-36C show end and two side views of the bottom front roll of station 8 of FIG. 10.

FIGS. 37A-37C show end and two side views of the bottom rear roll of station 8 of FIG. 10.

FIGS. 38A-38C show end and two side views of the top roll of station 9 of FIG. 10.

FIGS. 39A-39C show end and two side views of the bottom front roll of station 9 of FIG. 10.

FIGS. 40A-40C show end and two side views of the bottom rear roll of station 9 of FIG. 10.

FIGS. 41A-41C show end and two side views of the bottom rear roll of station 9 of FIG. 10.

FIGS. 42A-42C show end and two side views of the bottom rear roll of station 9 of FIG. 10.

DETAILED DESCRIPTION

Figure 1:
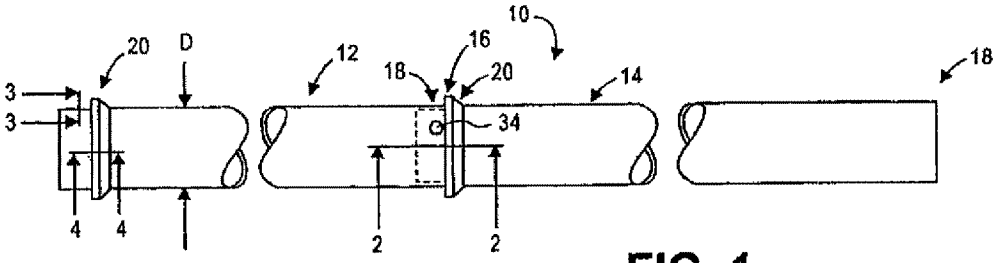
FIG. 1 is a schematic view of a portion of a duct system.

In this respect, before explaining at least one embodiment of the invention in detail, it is to be understood that the invention is not limited in its application to the details of construction and to the arrangements of the components set forth in the following description or illustrated in the drawings and that some embodiments are described by way of reference only. The invention is capable of embodiments in addition to those described and of being practiced and carried out in various ways. Also, it is to be understood that the phraseology and terminology employed herein are for the purpose of description and should not be regarded as limiting.

The invention will now be described with reference to the drawing figures, in which like reference numerals refer to like parts throughout. The roll former according to embodiments of the invention can be used in the formation of ducts, for example, such as the ducts illustrated in FIGS. 1-9 and disclosed in U.S. patent application Ser. No. 14/020,611, filed Sep. 6, 2013, the disclosure of which is incorporated by reference. As shown in FIG. 1, a pipe and fitting coupling system 10 includes a first pipe 12, a second pipe 14, and a joint 16. In addition to the straight pipes shown, the pipe and fitting coupling system 10 may include any suitable pipe and/or fitting known to those skilled in the art. Examples of suitable pipes and fittings include round and rectangular pipes, small and large radius elbow joints, 'Y' joints, 'T' joints, registers, and the like. Thus, for the sake of brevity, the term, "pipe 12" and "pipe 14" are used throughout the present disclosure and the figures depict a round pipe, however the embodiments are not limited to round pipes, but rather, the terms, "pipe 12" and "pipe 14" refer to round and rectangular pipe and fittings for the same.

To continue, the first pipe 12 has a pipe diameter D and a plain end 18. The second pipe has a receiving end 20. The receiving end is a single piece of shaped sheet metal. In general, the metal may include any suitable metal. Examples of suitable metals include steel, aluminum, alloys, and the like. In addition, the pipes 12 and/or 14 and receiving end 20 may be made of any other suitable material. Examples of suitable materials include malleable, injectable, and/or moldable materials such as, for example, plastics and other polymers, resins, and the like.

Figure 2:
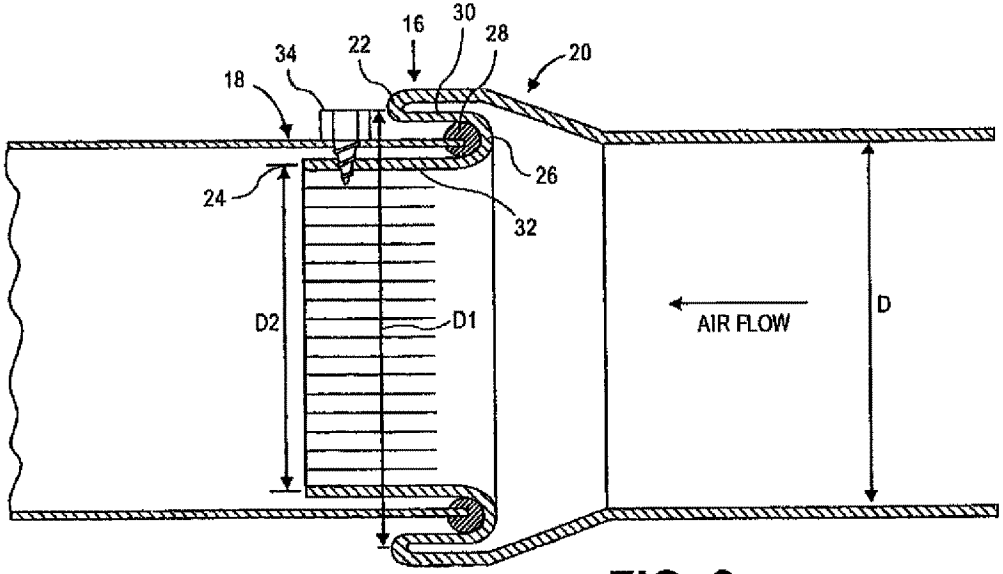
FIG. 2 is a cross-sectional view taken along line 2-2 of FIG. 1.

As shown in FIG. 2, the receiving end 20 includes a first axial flange 22, a second axial flange 24, an axial groove 26, and a sealant 28. In general, the axial flanges 22 and 24 facilitate positioning the plain end 18 in the axial groove 26. The sealant 28 includes any suitable elastomeric, resilient, or otherwise malleable material that is capable of forming and maintaining a seal with the plain end 18. Particular examples of suitable materials include butyl rubber and the like. The first axial flange 22 has a first flange diameter D1 that is greater than the pipe diameter D. The second axial flange 24 has a second flange diameter D2 that is less than the pipe diameter D. The second axial flange 24 extends further axially than the first axial flange 22. As described herein, this axial extension of the second axial flange 22 facilitates securing the plain end 18 of the first pipe 12 in the receiving end 20 of the second pipe 14.

The axial groove 26 is disposed at the pipe diameter and between the first axial flange 22 and the second axial flange 24. To facilitate telescoping the plain end 18 into the receiving end, the first axial flange 22 has an inwardly angled face 30 to meet the axial groove 26 and the second axial flange 24 has an outwardly angled face 32 to meet the axial groove 26. These angled faces 30 and 32 simplify the task of aligning the two ends 18 and 20 and initiating the telescoping of the plain end 18 towards the axial groove 26. The sealant 28 is disposed in the axial groove 26 to seal the plain end 18 in the receiving end 20. The joint 16 is formed by the cooperative alignment of the plain end 18 being inserted into the receiving end 20 and being sealed by the sealant 28.

Also shown in FIGS. 1 and 2 is a fastener 34. As shown in FIG. 2, the fastener 34 is configured to pierce a wall of the plain end 18 and a wall of the second axial flange 24. In this manner, the plain end 18 may be secured in the receiving end 20. In general, the fastener 34 includes any suitable fastener. Examples of suitable fasteners include screws, pop-rivets, and the like. In a particular example, the fastener 34 is a self-tapping metal screw.

Figure 3:
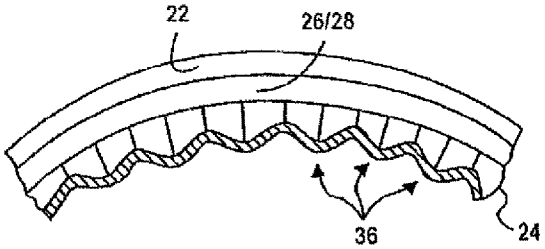
FIG. 3 is a cross-sectional view taken along line 3-3 of FIG. 1.

FIG. 3 is a cross-sectional view taken along line 3-3 of FIG. 1. As shown in FIG. 3, the second axial flange 24 includes a series of crimps 36 disposed about the circumference of the second axial flange 24. The series of crimps 36 are configured to provide a taper in the second axial flange 24. As such, the second axial flange is formed into a portion of a cone, e.g., a frusta-conical segment to facilitate telescopically sliding the plain end 18 over the second axial flange 24 and into the axial groove 26. In various embodiments, the size or width of each crimp of the series of crimps 36 is about 2 mm to about 15 mm. More particularly, each crimp is about 4 mm wide.

Figure 4:
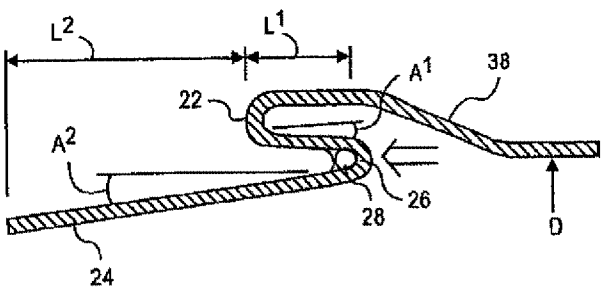
FIG. 4 is a cross-sectional view taken along line 4-4 of FIG. 1.

FIG. 4 is a cross-sectional view taken along line 4-4 of FIG. 1. As shown in FIG. 4, the inwardly angled face 30 of the first axial flange 22 includes an angle $A^1$. In general, the angle A1 includes any suitable angle. More particularly, the angle $A^1$ is about 1° to about 15° to facilitate telescopically sliding the plain end 18 into the axial groove 26. More particularly still, the angle $A^1$ is about 10°. The outwardly angled face 32 of the second axial flange 24 includes an angle $A^2$. In general, the angle $A^2$ includes any suitable angle. More particularly, the angle $A^2$ is about 1° to about 15° to facilitate telescopically sliding the plain end 18 into the axial groove 26. More particularly still, the angle $A^2$ is about 5°.

Also shown in FIG. 4, the first axial flange 22 extends a length $L^1$ past a bottom or proximal portion of the axial groove 26. The length $L^1$ includes any suitable length. In general, the length $L^1$ may vary from about ¼ inch (0.6 cm) to about ½ inch (1.3 cm). The second axial flange 24 extend a length $L^2$ past a distal end of the first axial flange 22. In general, the length $L^2$ is to provide sufficient area to secure the fastener 34. Depending upon the type of fastener utilized, the length $L^2$ may vary from about 1 cm to about 5 cm. In a particular example, the length $L^2$ is about 2.54 cm.

Figure 5:
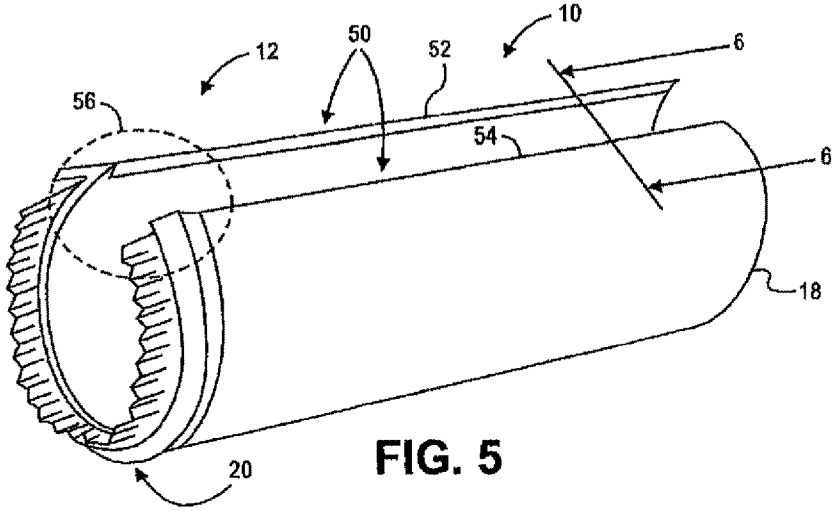
FIG. 5 is an isometric projection of a pipe of FIG. 1.

FIG. 5 is an isometric projection of the pipe 12 of FIG. 1. As shown in FIG. 5, the pipe 12 includes a longitudinal lock 50. The longitudinal lock 50 includes a male portion 52 and female portion 54. Also shown in FIG. 5 is an intersection zone 56 where the receiving end 20 (e.g., the transverse seal) intersects with the longitudinal lock 50. It is at this intersection zone 56 that the pipe and fitting coupling system 10 has the greatest tendency to leak. In order to offset this leakage tendency, additional sealant, such as the sealant 28, may be utilized as described herein.

Figure 6A:
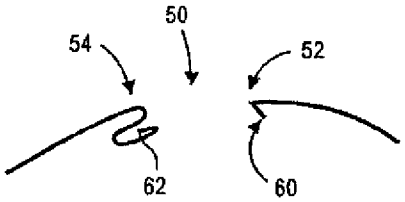
FIG. 6A is a cross-sectional view taken along line 6-6 of FIG. 5.
Figure 6B:
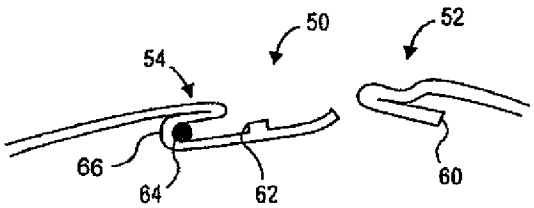
FIG. 6B is a cross-sectional view taken along line 6-6 of FIG. 5 in a locked conformation in accordance with the embodiment of FIG. 6A.

FIG. 6A is a cross-sectional view taken along line 6-6 of FIG. 5 in accordance with an embodiment of the invention. As shown in FIG. 6A, the male portion 52 includes a hem 60 and the female portion 54 includes a locking groove 62. As shown in FIG. 6B, in response to the male portion 52 being inserted sufficiently into the female portion 54, the hem 60 slides past the locking groove 62 and engages the locking groove 62 to secure the male portion 52 in the female portion 54.

Figure 7A:
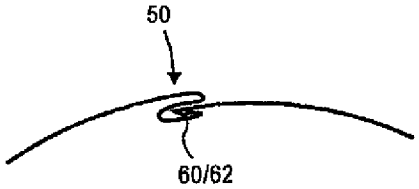
FIG. 7A is a cross-sectional view taken along line 6-6 of FIG.
Figure 7B:
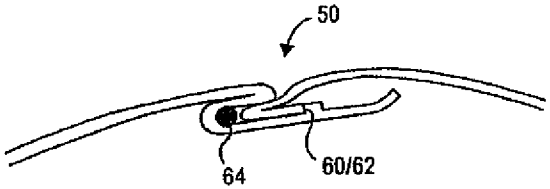
FIG. 7B is a cross-sectional view taken along line 6-6 of FIG. 5 in a locked conformation in accordance with the embodiment of FIG. 7B.

FIG. 7A is a cross-sectional view taken along line 6-6 of FIG. 5 in accordance with another embodiment of the invention. As shown in FIG. 7A, the male portion 52 includes the hem 60 and the female portion 54 includes the locking groove 62. Alternatively, the longitudinal lock 50 may include a button lock. In addition, the female portion 54 includes a sealant 64 disposed in a channel 66. As shown in FIG. 7B, in response to the male portion 52 being inserted sufficiently into the female portion 54, the male portion 52 is pressed against the sealant 64 to form a seal and the hem 60 slides past the locking groove 62 and engages the locking groove 62 to secure the male portion 52 in the female portion 54.

Figure 8:
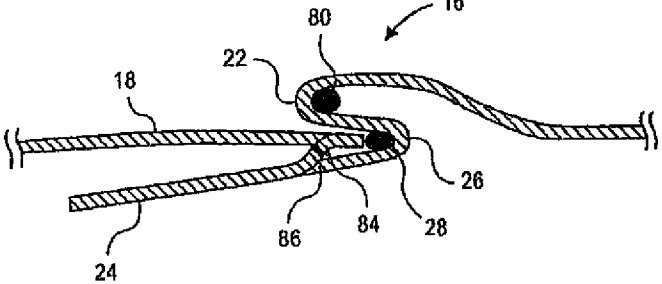
FIG. 8 is a cross-sectional view taken along line 4-4 of FIG. 1 in a locked conformation.

FIG. 8 is a cross-sectional view taken along line 4-4 of FIG. 1 in a locked conformation in accordance with another embodiment of the invention. As shown in FIG. 8, the pipe and fitting coupling system 10 optionally includes a sealant 80 in a groove corresponding to the back side of the first axial flange 22. If included, the sealant 80 is configured to reduce or eliminate air leakage at the intersection zone 56. That is, by placing in the groove corresponding to the back side of the first axial flange 22, air leakage at the intersection zone 56 has been reduced based upon empirical testing.

Also shown in FIG. 8, the pipe and fitting coupling system 10 optionally includes a lock 82 disposed at the joint 16 configured to secure the plain end 18 in the receiving end 20. In general, the lock 82 includes any suitable locking structure(s) such as tabs, barbs, hems, locking grooves, buttons, dimples, hooks, catches, detents, and the like. In a particular example, the plain end 18 includes a hem 84 and the receiving end 20 includes a locking groove 86. In various examples, the hem 84 and locking groove 86 may be configured to releasably engage or substantially non-releasably engage (that is, the engagement may be sufficiently secure such that uncoupling the joint 16 results in a permanent deformation of at least the hem 84 and locking groove 86). In yet another example, the plain end 18 includes a series of the hems 84 or buttons, dimples, and the like spaced about the circumference and the receiving end includes a series of locking grooves or catches spaced about the circumference. In this manner, the lock 82 may be selectively engaged by rotating the plain end 18 relative to the receiving end 20.

Figure 9:
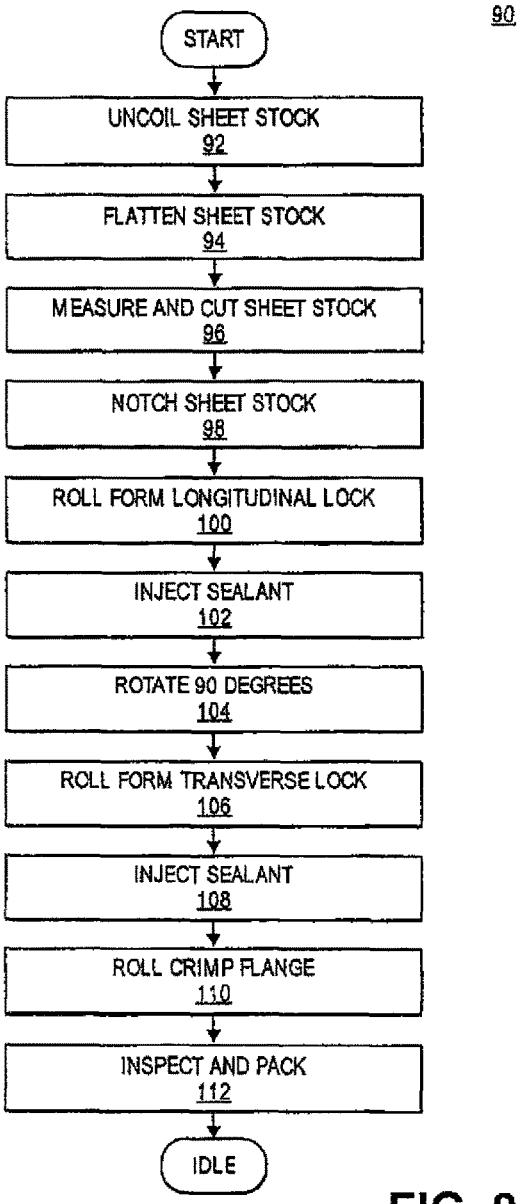
FIG. 9 is a flow diagram of a method of fabricating the pipe and fitting coupling system of FIG. 1.
Figure 10:
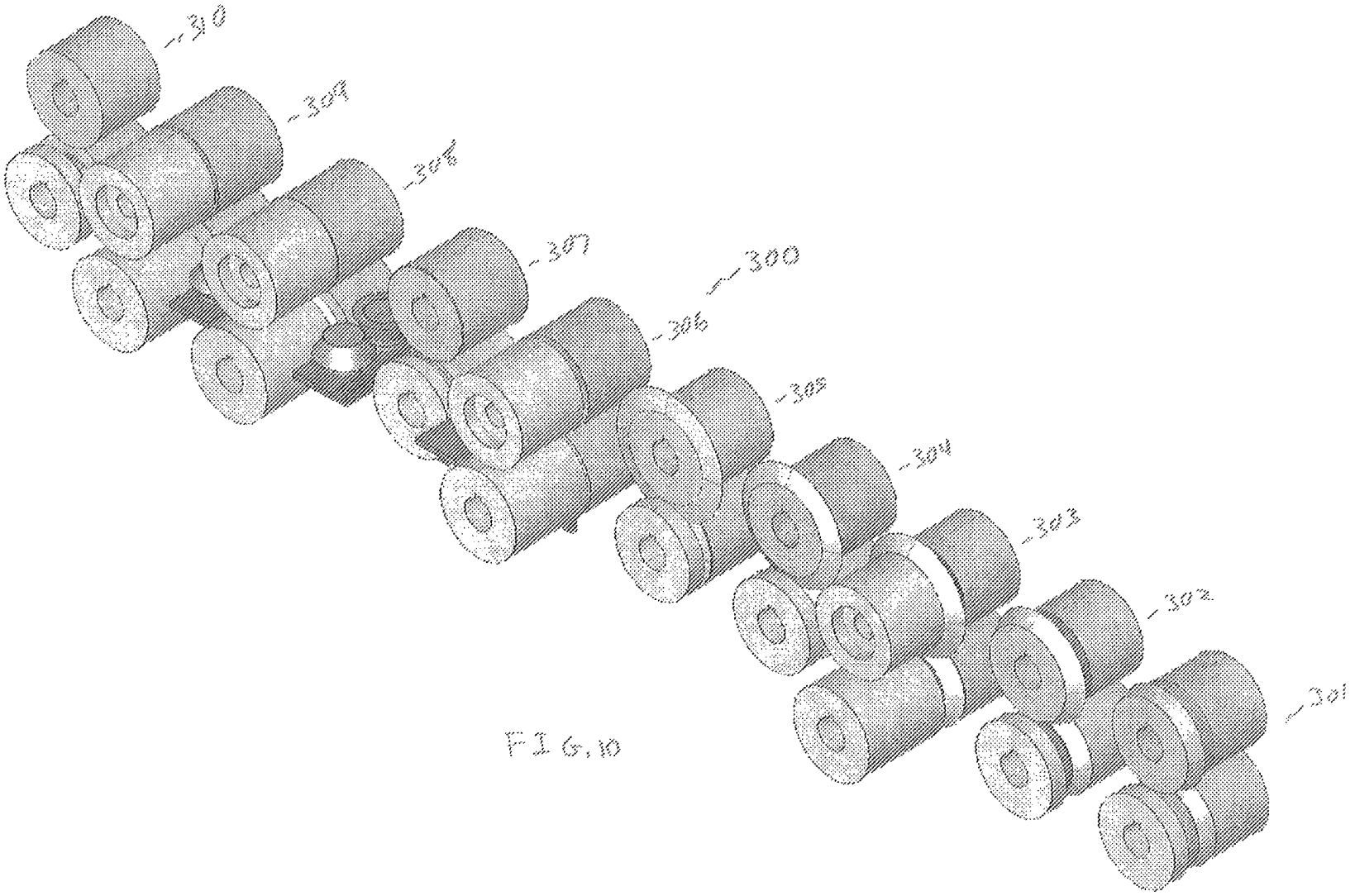
FIG. 10 shows a perspective view of embodiments of a roll forming.
Figure 11:
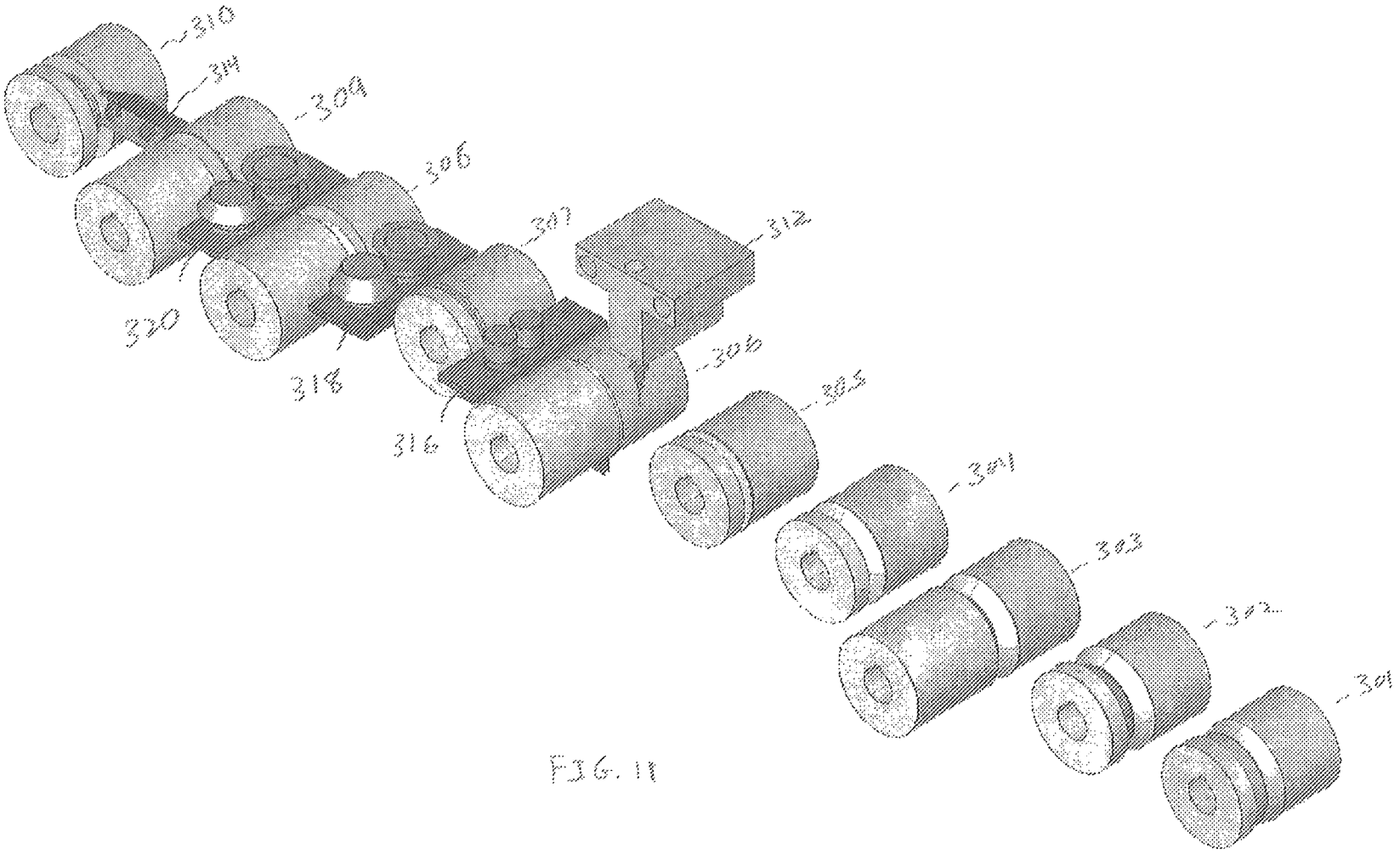
FIG. 11 shows stations 1-10 of the embodiment of FIG. 10 with top elongated rolls removed.

FIG. 9 is a flow diagram of a method 90 of fabricating the pipe and fitting coupling system of FIG. 1. In general, to fabricate a pipe such as the pipe 12 and 14, a supply of sheet metal is uncoiled with an uncoiler at step 92. The sheet metal is then flattened with a flattener to reduce the coil set, e.g., the tendency of the metal to coil at step 94. At step 96, the sheet metal is measured and cut to the predetermined dimensions by a shear, for example. A notcher removes segments of sheet metal that would otherwise interfere with the longitudinal or transverse locking mechanism at step 98. The notched sheet now travels to a conventional longitudinal lock former via a transfer table. At step 100, the sheet now receives the longitudinal lock 50 such as a "snap" lock shown in FIGS. 6A and 7A or "button" lock mechanism as shown in FIGS. 6B and 7B. One side is roll formed to a female lock, the other side to a male lock. While the locks are being formed, a sealant is injected into the female portion on the lock at step 102. Upon exiting the lock former, the pipe blank travels onto another transfer table that changes the direction of travel by 90 degrees at step 104. At step 106, the pipe blank enters the inventive roll former configured to form the receiving end 20.

In general, structures such as flanges and grooves are formed in sheet stock by passing the stock through a series of rolls or dies. A first roll in the series may initiate a bend and subsequent rolls accentuate the structure. In order to fabricate the receiving end 20, the receiving end 20 is 'flared' or otherwise formed with a die and/or rolls to generate an outwardly angled face 38. In general, the outwardly angled face 38 increases the diameter of the pipe from the diameter D to the diameter $D^1$. Once the outwardly angled face 38 is formed, the first axial flange 22, the axial groove 26 and second axial flange 24 are formed by passing the receiving end 20 through one or a series of rolls or dies. Following step 106, the sealant 28 is injected or otherwise disposed in the axial groove 26 at step 108. The blank then travels to a crimper machine and the series of crimps 36 may be formed in the second axial flange 24 at step 110. Following fabrication, the completed pipe 12 exits onto a run-out table where it is inspected and then packaged at step 112.

Alternatively, the pipe and fitting coupling system may be fabricated via a molding or casting process. For example, as is generally known, a negative mold of the pipe 12 may be generated and a material may be introduced to the mold to form the pipe 12.

Figure 13:
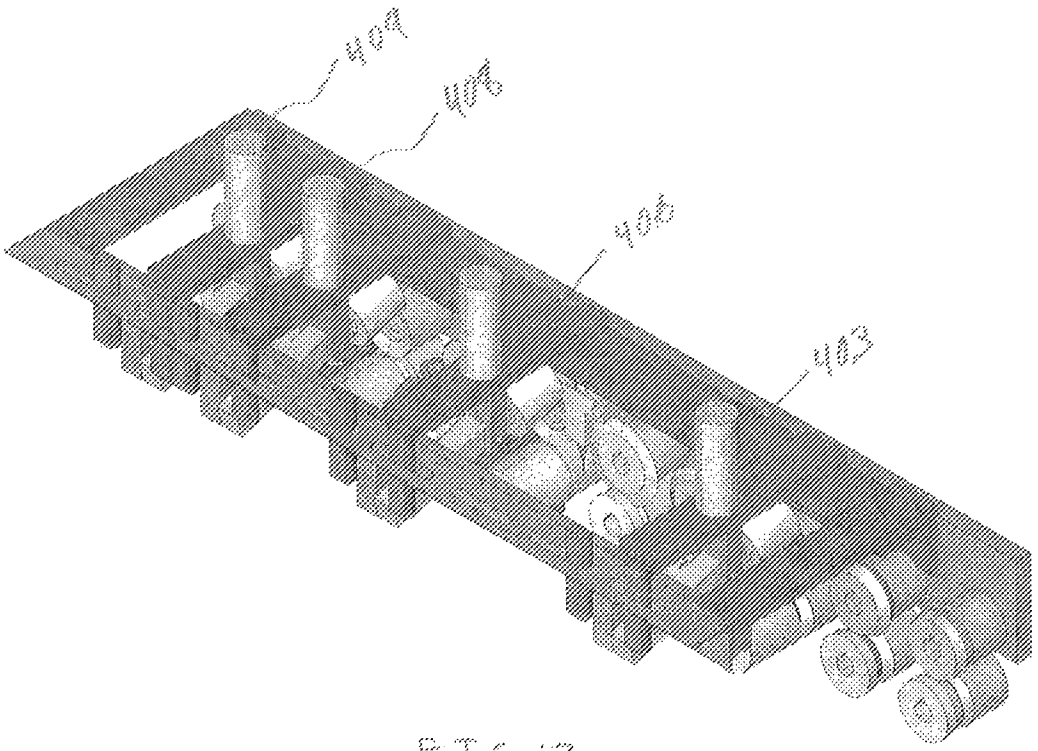
FIG. 13 shows the pivoting roller arrangement in a pivoted up position.
Figure 14:
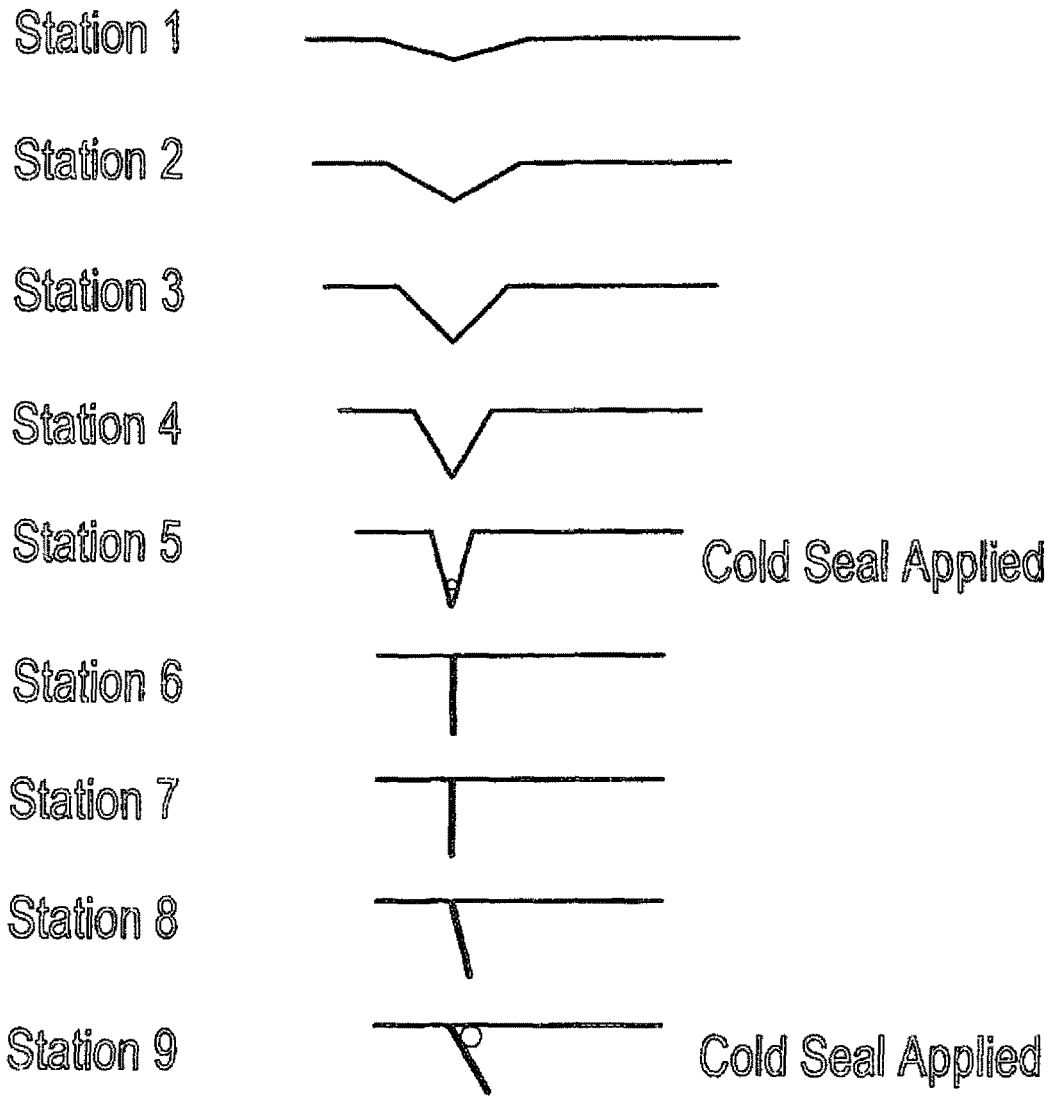
FIG. 14 shows how the pipe ducts is bent at stations 1-9 of FIG. 10.

Embodiments of a roll forming machine 300 used to form the receiving end 20 of pipe 12 are illustrated in FIGS. 10-42C. The roll forming machine 300 preferably has nine stations or more stations for forming the receiving end 20 on the pipe blank. In the illustrated embodiment, there are nine stations 1-9 (301 to 309). Each of stations 1-9 have a top roll and a bottom roll which both move the pipe blank forward while at the same time bending the pipe blank to form the receiving end 20 of pipe 12 as described above. Stations 1 (301) to 6 (306) form the pipe blank into a standing seam, stations 8 (308) and 9 (309) angle the seam to a specific angle depending on the gauge of the material so it will bend to form a pocket when rolled in a later process. The illustrated embodiment further includes a tenth station 10 (310). The top and bottom rollers at station 10 do not bend the pipe blank and serve to convey the pipe blank out of the roll former. The bend of the pipe blank at each station is shown in FIG. 14. FIGS. 15A to 42C show the top and bottom (front and rear) rolls of stations 1 to 9. As discussed above, a sealant injection nozzles 312, 314 are located between stations 5 (305) and 6 (306) and after station 9 (309) to inject sealant as described above. Sealant injection nozzle 312 injects sealant 80 in a groove corresponding to the back side of the first axial flange 22 of receiving end 20, while sealant injection nozzle 314 injects sealant 28 in the axial groove 26.

Figure 12:
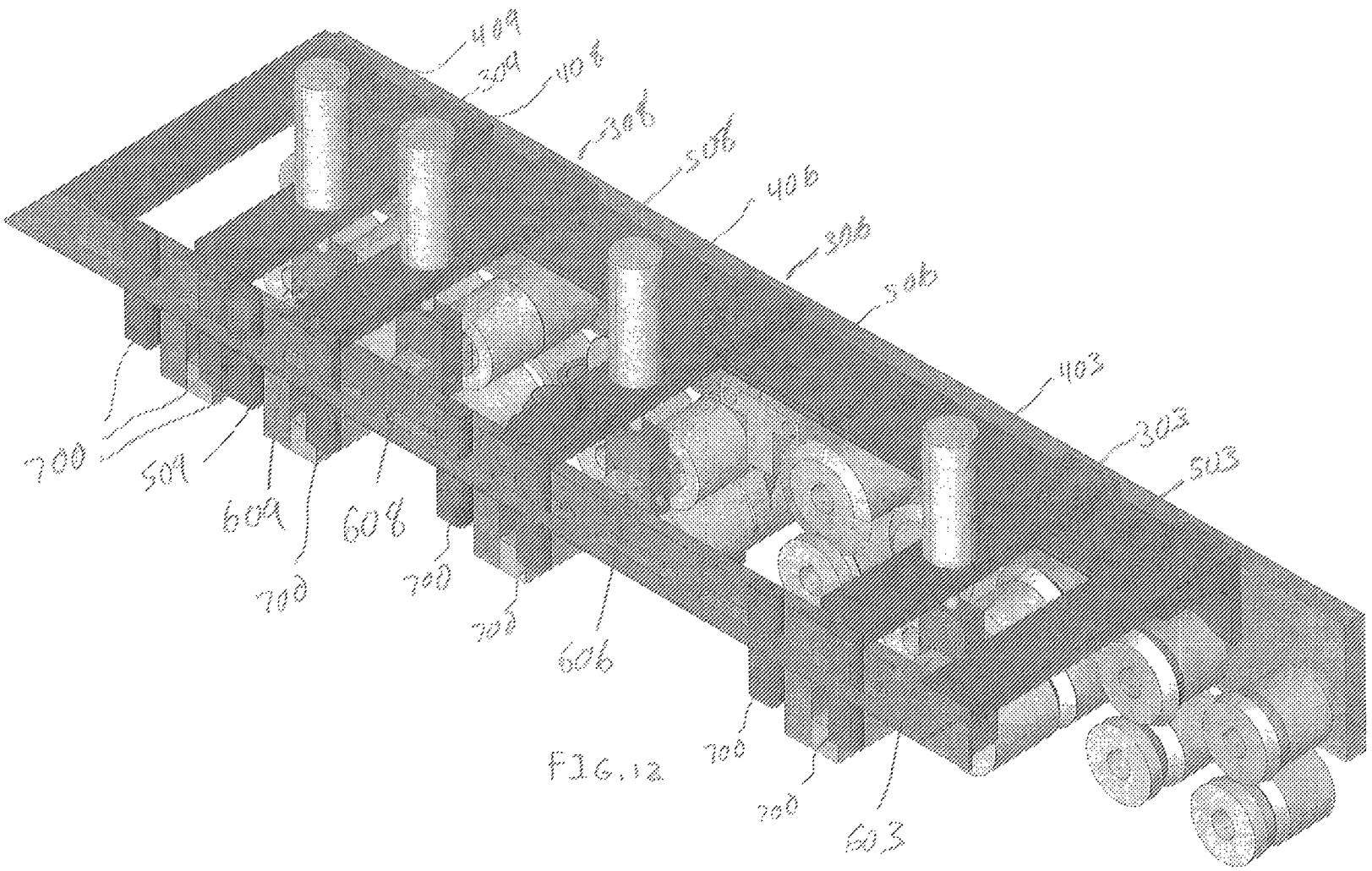
FIG. 12 shows stations 1-10 of the embodiment of FIG. 10 showing the pivoting roller arrangement.

The roll forming machine 300 preferably has elongated top and bottom rolls at stations 3 (303), 6 (306), 8 (308) and 9 (309). The elongated top and bottom rolls allow the single headed roll former to clinch the pipe blank during the forming process. To accomplish this task, the bottom rolls at stations 3 (303), 6 (306), 8 (308) and 9 (309) are attached to a longer shaft driving the bottom rolls. The top rolls at stations 3 (303), 6 (306), 8 (308) and 9 (309) are mounted on shafts (603, 606, 608, 609) that are allowed to pivot with the help of air cylinders (403, 406, 408, 409). FIG. 12 shows the top rolls at stations 3 (303), 6 (306), 8 (308) and 9 (309) in an un-pivoted position. FIG. 13 shows top rolls at stations 3 (303), 6 (306), 8 (308) and 9 (309) in a pivoted-up position. Shafts (603, 606, 608, 609) are operatively connected to air cylinders (403, 406, 408, 409) by clevises (503, 506, 508, 509). When the beginning or the end of a pipe blank approaches, visual sensors 700 actuate the air cylinders (403, 406, 408, 409) causing the top rolls at stations 3 (303), 6 (306), 8 (308) and 9 (309) to temporarily lift up to release pressure on the pipe blank and allow the male or female longitudinal lock to pass. Once past, the air cylinder releases the roll and again clinches the pipe blank to prevent it from shifting during the forming process. This added pressure on the pipe blank helps keep the material to stay straight in the rolls and therefore produces a much more consistent lock. If the rollers did not move up and down, they would flatten the longitudinal lock with their pressure.

The roll forming machine 300 preferably includes three sets of horizontal rolls (vertical axis) located between stations 6 (306) and 7 (307), stations 7 (307) and 8 (308), and stations 8 (308) and 9 (309). The primary purpose of these rolls is to guide the pipe blank as it is being formed in the roll forming machine 300. A first set 316 of horizontal rolls between station 6 (306) and 7 (307) guides the standing flange (first axial flange 22) into the next set of rolls that pinch it shut. The second set 318 of horizontal rolls stations between 7 (307) and 8 (308) as well as the third set 320 between stations 8 (308) and 9 (309) hold the flange at the desired angle and prevent the flange to move out of position, creating an uneven lock.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A roll forming apparatus comprising:

a plurality of stations each including and an upper roller and a lower roller, wherein a first number of stations are configured to form a standing seam on a pipe blank, wherein the standing seam comprises a first flange, a second flange, and a groove formed between the first flange and the second flange, and a second number of stations are configured to angle the standing seam to form a second groove between an outer face of the standing seam and the pipe blank, wherein at least one station includes elongated upper and lower rollers, wherein the elongated upper and lower rollers are elongated with respect to upper and lower rollers at other stations for clinching the pipe blank during the roll forming process;

wherein each elongated upper roller is mounted on a pivotable shaft configured to pivot the elongated upper rollers away from the pipe blank; and the roll former apparatus further comprises at least one sensor arranged for sensing the standing seam and configured to cause the pivotal shafts to pivot the elongated upper rollers away from the pipe blank in response to sensing of the standing seam to allow passage of the standing seam formed in the pipe blank.

2. The roll forming apparatus of claim 1, further comprising a first sealant injection nozzle disposed at the first number of stations configured to inject sealant into the first groove.

3. The roll forming apparatus of claim 2, further comprising a second sealant injection nozzle disposed at the second number of stations configured to inject sealant into the second groove.

4. The roll forming apparatus of claim 1, further comprising at least one set of vertical axis rollers disposed between a pair of stations to guide the pipe blank as it is being formed in the roll forming machine.

5. The roll forming apparatus of claim 1, further comprising wherein each pivotable shaft is operatively connected to an air cylinder for pivoting the pivotable shaft in response to sensing of the standing seam.

6. A method of forming a pipe blank in a roll former the method comprising:

forming a standing seam on a pipe blank at a first number of stations of the roll former, wherein the standing seam comprises a first flange, a second flange, and a groove formed between the first flange and the second flange;

angling the standing seam at a second number of stations of the roll former, wherein the standing seam is angled to form a second groove between an outer face of the standing seam and the pipe blank, wherein the first and second number of stations includes elongated upper and lower rollers for clinching the pipe blank during the roll forming process, wherein the elongated upper and lower rollers are elongated with respect to upper and lower rollers at other stations;

sensing the standing seam of the pipe blank; and pivoting each elongated upper roller away from the pipe blank to allow passage of at least one seam formed in the pipe blank in response to sensing the standing seam.

7. The method of claim 6, further comprising injecting a sealant into the first groove with a first sealant injection nozzle disposed at the first number of stations.

8. The method of claim 7, further comprising injecting a sealant into the second groove with a second sealant injection nozzle disposed at the second number of stations.

* * * * *